US008225561B2

(12) United States Patent
Voegele, Jr. et al.

(10) Patent No.: US 8,225,561 B2
(45) Date of Patent: Jul. 24, 2012

(54) HYBRID SKYLIGHT AND WALL PANEL SYSTEM

(75) Inventors: William P. Voegele, Jr., Pittsburgh, PA (US); Kevin P. Smith, Glenshaw, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 180 days.

(21) Appl. No.: 12/684,992

(22) Filed: Jan. 11, 2010

(65) Prior Publication Data

US 2010/0212238 A1 Aug. 26, 2010

Related U.S. Application Data

(60) Provisional application No. 61/154,477, filed on Feb. 23, 2009.

(51) Int. Cl.
*E06B 7/00* (2006.01)
*E06B 3/00* (2006.01)
*E06B 3/988* (2006.01)

(52) U.S. Cl. ..... 52/204.595; 52/204.5; 52/204.71; 52/204.72

(58) Field of Classification Search ..... 52/204.595, 52/204.5, 204.53, 204.54, 204.59, 204.591, 52/204.593, 204.71, 204.72
See application file for complete search history.

(56) References Cited

U.S. PATENT DOCUMENTS

| | | | | |
|---|---|---|---|---|
| 4,335,551 | A | | 6/1982 | Benkelman et al. |
| 4,569,872 | A | | 2/1986 | Miller |
| 4,680,905 | A | * | 7/1987 | Rockar ..... 52/200 |
| 4,884,376 | A | * | 12/1989 | DeBlock et al. ..... 52/92.2 |
| 4,996,809 | A | * | 3/1991 | Beard ..... 52/200 |
| 5,343,660 | A | * | 9/1994 | Caoduro et al. ..... 52/86 |
| 5,437,129 | A | | 8/1995 | Konstantin |
| 5,509,250 | A | * | 4/1996 | Jensen et al. ..... 52/200 |
| 5,765,324 | A | | 6/1998 | Schultz |
| 5,797,225 | A | * | 8/1998 | Ishikawa ..... 52/93.1 |
| 5,972,475 | A | | 10/1999 | Beekman |
| 6,079,167 | A | | 6/2000 | Voegele, Jr. et al. |
| 6,088,978 | A | | 7/2000 | Satterwhite |
| 6,263,624 | B1 | | 7/2001 | Hoy et al. |
| 6,871,459 | B2 | | 3/2005 | Van Dame |
| 7,281,353 | B2 | | 10/2007 | Konstantin |
| 2005/0136198 | A1 | | 6/2005 | Bourlier et al. |
| 2006/0144013 | A1 | | 7/2006 | Rouanet et al. |

* cited by examiner

*Primary Examiner* — Mark Wendell

(74) *Attorney, Agent, or Firm* — McKay & Associates, P.C.

(57) ABSTRACT

A layered panel and framing system for use as a skylight or wall, formed from extrusions which capture and frame variable panels. An upper extrusion has an upper hole defined therein. An upper spacer has an upper spacer hole defined therein in alignment with the upper hole of the upper extrusion. An intermediate extrusion then has an intermediate hole defined therein offset from the upper holes and the upper spacer hole. A lower spacer has a lower spacer hole defined therein in alignment with the intermediate hole. A base extrusion is formed at the top of a rafter. A bottom plastic panel is captured between the intermediate extrusion and the base extrusion, and a top glass panel is captured between the intermediate extrusion and the upper extrusion, wherein the bottom panel and the top panel are spaced a distance substantially equal to a height of the intermediate extrusion.

13 Claims, 6 Drawing Sheets

HYBRID SKYLIGHT AND WALL PANEL SYSTEM

SPECIFIC REFERENCE

The instant application hereby claims benefit of provisional application Ser. No. 61/154,477, filed Feb. 23, 2009 entitled "Hybrid Skylight/Wall System".

BACKGROUND

In the skylight and light transmitting wall industry, systems are typically glazed with either plastic (single layered or multi-layered) or with glass (single layered or double layered insulated)). Large skylights are typically glazed with multiple pieces of glass, most often two layers of glass sealed together at the edges. These are known as IG (insulated glass) units. They have become the most common glazing material for monumental (large) glass walls and skylights.

Briefly, for example, U.S. Pat. No. 4,569,872 to Miller shows an insulating, translucent panel utilizing two sheets mounted within a frame. U.S. Patent Pub. No. 2005/0136198 to Bourlier et al. shows an insulating glass unit with an insert in the airspace. U.S. Patent Pub. No 2006/0144013 to Rouanet et al. teaches an insulated panel and glazing system.

"Insulated glass" units typically require laminated glass interior sheets and tempered or heat-strengthened glass exterior sheets. Building codes also typically require that the inner glass lites be made of glass which is tempered and laminated. Typically, laminated glass may consist of two pieces of 3/16" thick glass with a 0.060" thick plastic interlayer incited between the two pieces. Presumably, in the event of breakage, this combination is less likely to fall in harmful pieces. Further, those interior and exterior glass sheets (lites) are hermetically sealed to each other around the perimeter and they rely on having the space between them filled with dry-air or filled with an inert gas. When a break in the perimeter seal occurs, the insulated glass units must be replaced with similar units, all at considerable cost and danger.

Among many other drawbacks, one of the ongoing problems with IC units is that they lose their seal with age. As a result, they will fog up, i.e. condensation appears in the air space. In so doing they do not look appealing and they lose some of their insulating value. Also, when an IC unit must be replaced, there will be a large hole in the roof or wall until replacement is complete. This results in an increase in energy costs and may compromise the security of the building.

In this age of energy awareness, there is need for a skylight/wall glazing configuration which is more highly insulating and which has longer life than conventional configurations.

SUMMARY

It is the objective of the present invention to provide a panel system comprising variable materials, spatially arranged, and which can be installed in layers such that if the outer layer of the hybrid skylight/wall is to be replaced, an inner layer will remain to provide an air barrier and will also serve to keep objects from falling into the building and will maintain building security during the replacement process.

It is further the objective of the present invention to provide a panel system where there can be no glass unit seal failure.

It is further the objective of the present invention to provide a panel system wherein the framing system is thermally broken.

It is further the objective to provide a panel system wherein the containment of each of the glazing materials is accomplished with controlled pressure, high thermal insulating value is achieved, and an impact-resistant inner surface is established.

It is further the objective to provide a panel system which is aesthetically pleasing and which eliminates hot spots, i.e. areas of extreme, concentrated light within a room.

It is further the objective of the present invention to provide a panel system which offers the desirable weatherability of exposed glass while incorporating the superior insulating value and strength of a cellular plastic panel.

It is further the objective of the present invention to provide a panel system wherein the weight per square foot is approximately 2.1 lbs. per square foot lighter than conventional glass systems.

Accordingly, in the preferred embodiment what is provided is a multi-layered, hybrid panel framing system, comprising three extrusions. First, an upper extrusion has an upper hole defined therein. An upper spacer has an upper spacer hole defined therein in alignment with the upper hole of the upper extrusion. An intermediate extrusion then has an intermediate hole defined therein offset from the upper holes and the upper spacer hole. A lower spacer has a lower spacer hole defined therein in alignment with the intermediate hole. Finally, a base extrusion is formed integrally as a rafter or at the top of a rafter. Thus, a bottom panel, preferably plastic, is captured underneath the intermediate extrusion and above the base extrusion, and a top panel, preferably glass, is captured above the intermediate extrusion and underneath the upper extrusion, wherein the bottom panel and the top panel are spaced a distance substantially equal to a height of the intermediate extrusion.

Upper and lower screws are fastened through the upper hole and through the upper spacer hole joining the upper extrusion and the upper spacer to the intermediate extrusion so as to provide a compression force to secure the top and bottom panels. The upper extrusion has two upper extrusion ends and a pair of upper extrusion gaskets situated facing downwardly at the upper extrusion ends. The intermediate extrusion has an intermediate underside, an intermediate top, and two intermediate extrusion ends. The intermediate extrusion further includes a pair of intermediate bottom gaskets situated facing downwardly from the intermediate underside at the two intermediate extrusion ends and further includes a pair of intermediate top gaskets situated facing upwardly from the intermediate top at the two intermediate extrusion ends. The base extrusion has two base extrusion ends and a pair of base extrusion gaskets situated at the base extrusion ends facing upwardly. Accordingly, the bottom panel is situated between the base extrusion and the intermediate extrusion and in contact with the base extrusion gaskets and the intermediate bottom gaskets, and the top panel is situated between the intermediate extrusion and the upper extrusion and in contact with the intermediate top gaskets and the upper extrusion gaskets.

In an alternative embodiment, the panel system includes an additional panel, preferably glass. This is accomplished by providing a secondary spacer and a secondary extrusion. The secondary extrusion is substantially similar to the intermediate extrusion adapted to be placed between the intermediate extrusion and the base extrusion such that an additional panel can be captured underneath the secondary extrusion and above the base extrusion to form a three-panel system consisting of the top panel, the bottom panel, and the additional panel, each panel being spaced a distance relative to each other, the distance being substantially equal to the height of the intermediate extrusion and the height of the secondary extrusion.

DETAILED DESCRIPTION OF THE PREFERRED EMBODIMENT

Figure 1:
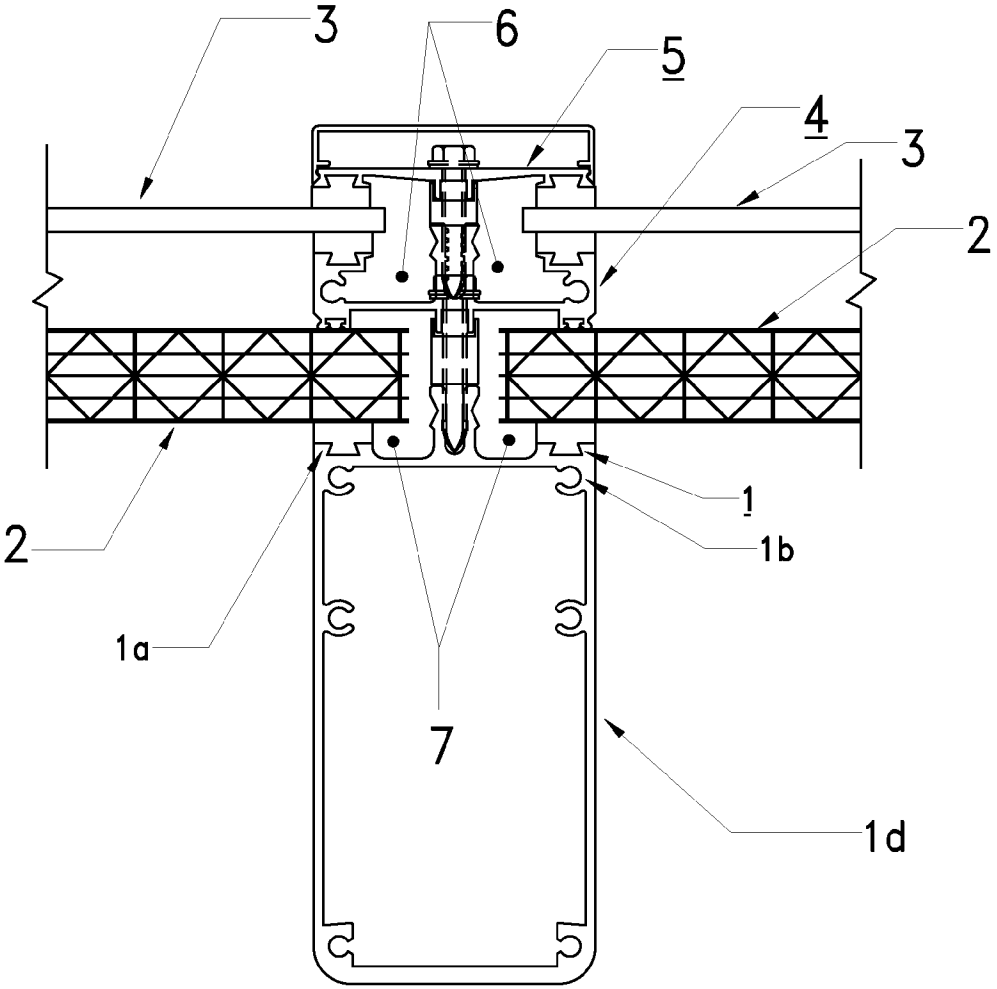
FIG. 1 shows a cross-sectional view of the instant panel system through the frame when assembled.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention.

Generally, in the preferred embodiment, "hybrid" as used herein refers to a hybrid skylight/wall design composed preferably of an outer layer of glass and an inner layer of cellular or monolithic plastic, and the instant application recites a method for quickly and reliably assembling same. In an alternative embodiment the bottom plastic panel can be substituted with an insulated glass unit (as described with reference to FIG. 8) in instances where desirable or required due to building requirements. Further expansion of this idea includes a third (glass) inner layer, as will be described. In all cases, the exterior glass is typically ¼" or thicker and provides reliable weatherability. It can also incorporate desirable finishes, such as the energy-friendly treatment known as "low e", on its inner surface. The cellular plastic, typically polycarbonate or acrylic, which forms the second layer, contributes greatly to the overall thermal R-value of the system. In fact, an R-value in the range of 5.8 can be attained even without special coating. This compares with an R-value of 2.8 for a typical double glass glazed system.

The alternative, additional panel or third (glass) layer can become part of this hybrid construction. This glass inner layer, either monolithic or laminated or fire-rated, typically ⅛" to ½" thick, will serve to increase the insulating value even further (taking it to the range of 7.4) and will provide a non-combustible inner surface in those particular applications where building codes demand such an interior surface.

As will be further described, all of the above combinations of glazing layers are assembled using a series of gasketed aluminum extrusions, creating a layered assembly system. For example, in the case of the glass/plastic hybrid, the plastic panels rest on the gasketing of the base (structural) extrusion. Owing to plastic spacer blocks, the interim gasketed aluminum extrusion is positioned to hold the plastic panels in place, giving sufficient pressure to create a seal, but not so much as to crush the plastic. These spacer blocks, being thermally non-conductive, further provide thermal breaks for the aluminum framing. The gasketing which contacts the plastic is of a flexible material, such as neoprene, which is chemically compatible with the plastic. The construction of lites, gasketed extrusions, and panels is designed such that it can be assembled in layers, and such that all assembly work can be done from the outside of the building. As each layer of extrusions is installed, pre-punched holes in each topmost extrusion align with screw tracks in the extrusion immediately beneath, thus aligning the two (over and under) extrusions in their side to side relationship. The number of holes and other components will vary depending on the overall length of the extrusion and the size requirements for the skylight or wall because the extrusions typically travel the length (or width) of the skylight or wall. Accordingly, as used in the claim and as disclosed, "a" or "an" means one or more.

Figure 2:
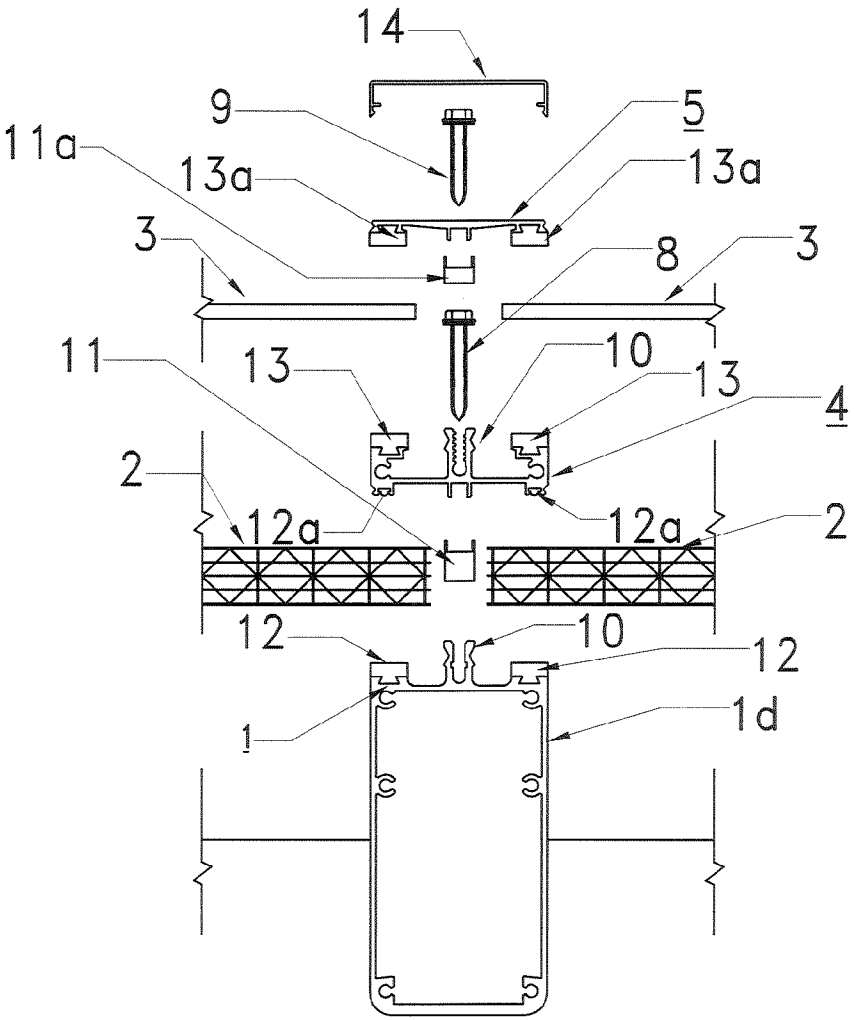
FIG. 2 shows an exploded cross-sectional view of embodiment shown in FIG. 1.
Figure 5:
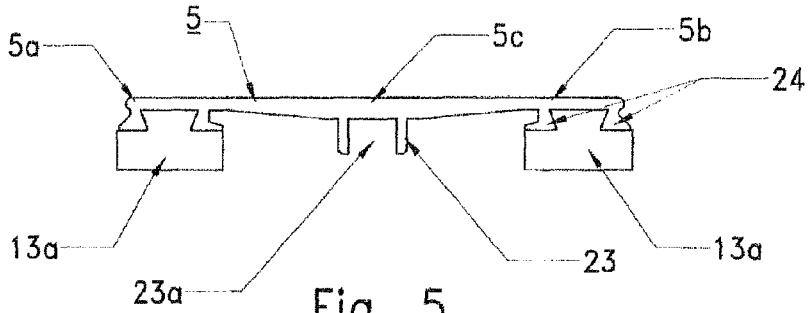
FIG. 5 shows a blow-up cross-section of the upper extrusion.
Figure 6:
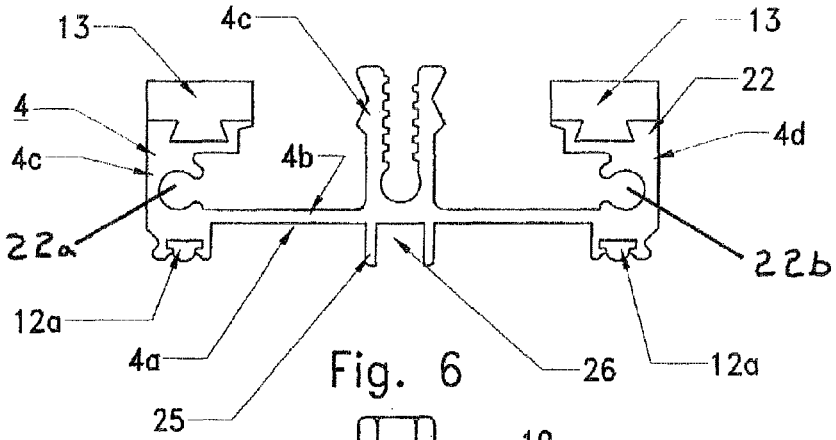
FIG. 6 shows a blow-up cross-section of the intermediate extrusion.
Figure 7:
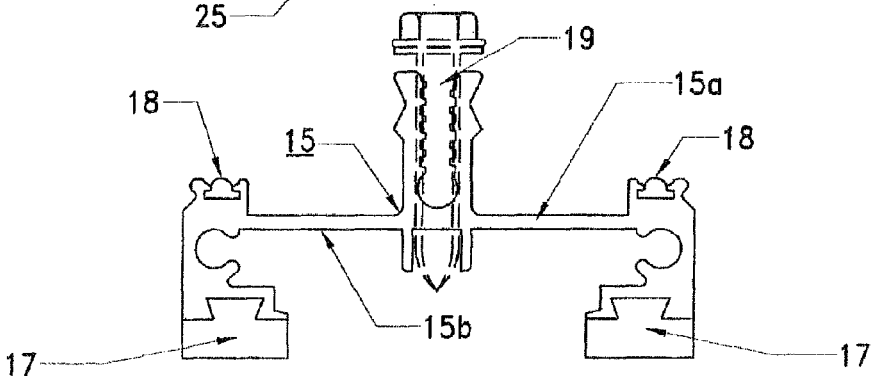
FIG. 7 shows a blow-up cross-section of the secondary extrusion.

With reference then to FIGS. 1-2 and in conjunction with FIGS. 5-6 (extrusion detail), shown is the first embodiment of a multi-layered, hybrid panel system. A base extrusion 1 having two base extrusion ends 1*a*, 1*b* is formed at the top of a rafter 1*d* or structural mullion, either integral thereto or as a separate attachment depending on the existence of any prefabricated support. For example the rafter 1*d* may pre-exist as part of the original building construction or, as is typical, fabricated as part of the instant assembly. Extrusions described herein are typically made of aluminum or PVC or other lightweight, rigid material. Base extrusion 1 comprises a generally U-shaped, base extrusion track 10 projecting upwards in a generally vertical fashion which is adapted to receive an end of lower screw 8, as further described. A pair of base extrusion gaskets 12 are situated at the base extrusion ends 1*a*, 1*b* facing upwardly. Base extrusion gaskets 12 are accommodated therein by providing a pair of projections formed at each base extrusion end 1*a*, 1*b*, and these projections define raised webs 22 formed integral to the base extrusion 1, as a result grasping a portion of each base extrusion gasket 12 and maintaining each in its upward position.

An upper extrusion 5 is then provided. Upper extrusion 5 has an upper hole 5*c* defined therein (FIG. 5 only). The holes can be pre-punched in the topmost surface of this extrusion and are adapted to receive upper screws 9, as further described. A pair of upper channel elements 23 project downward from a bottom surface of the upper extrusion 5 to define an upper channel 23*a* through which the upper screw 9 can be guided. Similar to the base extrusion 1 as above but inverted, upper extrusion 5 includes a pair of lowered webs 24 formed at the two upper extrusion ends 5*a*, 5*b* by having a pair of projections thereon. Lowered web 24 formed by these projections then grasps and secures each upper extrusion gasket 13*a* and maintains each upper extrusion gasket 13*a* in a downward position.

Also provided is intermediate extrusion 4. Intermediate extrusion 4 has an intermediate hole (not shown) defined therein offset from upper hole 5*c* of upper extrusion 5. This hole is also preferably pre-punched in intermediate extrusion top (intermediate top 4*b*) and is adapted to receive a similar screw as would penetrate upper extrusion 5. Any hole in an upper extrusion 5 will be offset from any underlying intermediate hole in the below intermediate extrusion 4 because any top hole aligns with a screw track below rather than a hole, and during assembly all holes will remain accessible to receive a screw. Similar to base extrusion 1, intermediate extrusion 4 has a generally U-shaped, intermediate extrusion track 4*e*. Intermediate extrusion track 4*e* is in alignment with the upper hole 5*c* of upper extrusion 5 so it can capture upper screw 9. A pair of intermediate channel elements 25 project downward from a bottom surface of the intermediate extrusion 4 to define an intermediate channel 26 through which the lower screw 8 can be guided and enter base extrusion track 10. Intermediate extrusion 4 further has an intermediate underside 4*a* along with intermediate top 4*b*, and two intermediate extrusion ends 4*c*, 4*d*. Accordingly, a pair of intermediate bottom gaskets 12*a* can be situated facing downwardly from the intermediate underside 4*a* at the two intermediate extrusion ends 4*c*, 4*d* and a pair of intermediate top gaskets 13 can be situated facing upwardly from the intermediate top 4*b*. This is accomplished by providing each intermediate top 4*b* with a pair of projections formed at each intermediate extrusion end 4*c*, 4*d*, wherein the projections define a raised web 22 similar to the raised web 22 of base extrusion 1, integral to the intermediate extrusion 4 to grasp a portion of each intermediate top gasket 13 and maintain each intermediate top gasket 13 in its upward position. Each intermediate underside 4*a* then includes a pair of projections formed at the same ends but which define a lowered web 24 integral thereto to respectively contain a portion of each intermediate bottom gasket 12*a* and maintain each one in its downward position. Each space defined between each lowered web 24 and the raised web 22 is a hollow boss or screw boss 22*a*, 22*b* formed as a segmented cylinder separating each raised web 22 from the respective lowered web 24 which is adapted to accept a boss screw to secure intermediate extrusion 4 to a horizontal member such as a head member or sill (see also the secondary extrusion 15 and base extrusion 1 as the same features apply for fastening). The lowered webs 24 of the intermediate underside 4*a* are smaller than the raised webs 22 of the intermediate top 4*b* and accordingly the intermediate bottom gaskets 12*a* preferably are smaller than the intermediate top gaskets 13. Intermediate top gaskets 13 are preferably thicker and softer than intermediate bottom gaskets 12*a* because glass, being obviously breakable if stressed, requires thicker and softer gaskets in most instances.

An upper spacer 11 has an upper spacer hole 11*b* defined therein in alignment with the upper hole of the upper extrusion 5. A lower spacer 11*a* has a lower spacer hole 11*c* defined therein adapted to align with the intermediate hole of intermediate extrusion 4. Spacer as defined herein is a plastic, composite, or other non-conductive material block such as urethane which gives sufficient pressure to create a seal, but not so much as to crush plastic panels. These spacer blocks, being thermally non-conductive, also provide thermal breaks for the aluminum framing/extrusions. Note also that the upper channel elements 23 of upper extrusion 5 are sized to be accommodated within the upper spacer 11, thereby forming a tight fit and seal. The intermediate channel elements 25 then are sized to be accommodated in similar fashion within the lower spacer 11*a*.

A bottom panel 2 is captured underneath the intermediate extrusion 4 and above the base extrusion 1, situated in contact with the base extrusion gaskets 12 and the intermediate bottom gaskets 12*a*. The bottom panel 2 is preferably plastic. In the preferred embodiment the bottom panel 2 is cellular polycarbonate ranging in thickness from 6 mm to 60 mm. As noted heretofore and in the summary, although an additional glass or insulated glass layer may be used, use of cellular polycarbonate has many advantages, especially when spatially arranged with one or more glass panels.

In similar fashion, a top panel 3 is then captured above the intermediate extrusion 4 and underneath the upper extrusion 5 situated in contact with the intermediate top gaskets 13 and the upper extrusion gaskets 13*a*. However, the top panel is preferably glass as opposed to plastic.

As part of the assembly and assembly method, lower screw 8 is fastened through the intermediate hole of intermediate extrusion 4 and through the lower spacer hole, joining the intermediate extrusion 4 and the lower spacer 11 to the base extrusion 1. A compression force is achieved to secure the bottom, plastic panel 2 between intermediate extrusion 4 and base extrusion 1. An upper screw 9 is fastened through the upper hole of upper extrusion 5 and through the upper spacer hole joining the upper extrusion 5 and the upper spacer 11 to the intermediate extrusion 4 so as to provide a compression force to secure the top, glass panel 3 between upper extrusion 5 and intermediate extrusion 4. As a result, this hybrid assembly is achieved wherein the top panel 3 can be separately removed for repair and replacement by removing upper screw 9 while the bottom panel 2 remains in place. Note that the bottom panel 2 and the top panel 3 are spaced a distance substantially equal to a height of the intermediate extrusion 4. "Substantially equal" as used herein means the space between the panels is equal to the size of the intermediate extrusion 4 (including gaskets 12*a*, 12) varying only slightly by the size, compression force and resistance of the intermediate top gaskets 13 and the intermediate bottom gaskets 12*a*. In the preferred embodiment the height of each extrusion is one inch (1") and thus the size of the space between each panel is substantially equal to 1 inch. Note also that pockets 6, 7 are defined by the instant configuration to act as gutters, capable of carrying off leakage water.

A cap 14 is provided formed as another extrusion, generally U-shaped in cross-section so that is adapted to be inverted and clipped onto the upper extrusion 5 to hide the upper screw 9 and top components of the extrusion/framing assembly, resulting in a seamless appearance.

Figure 3:
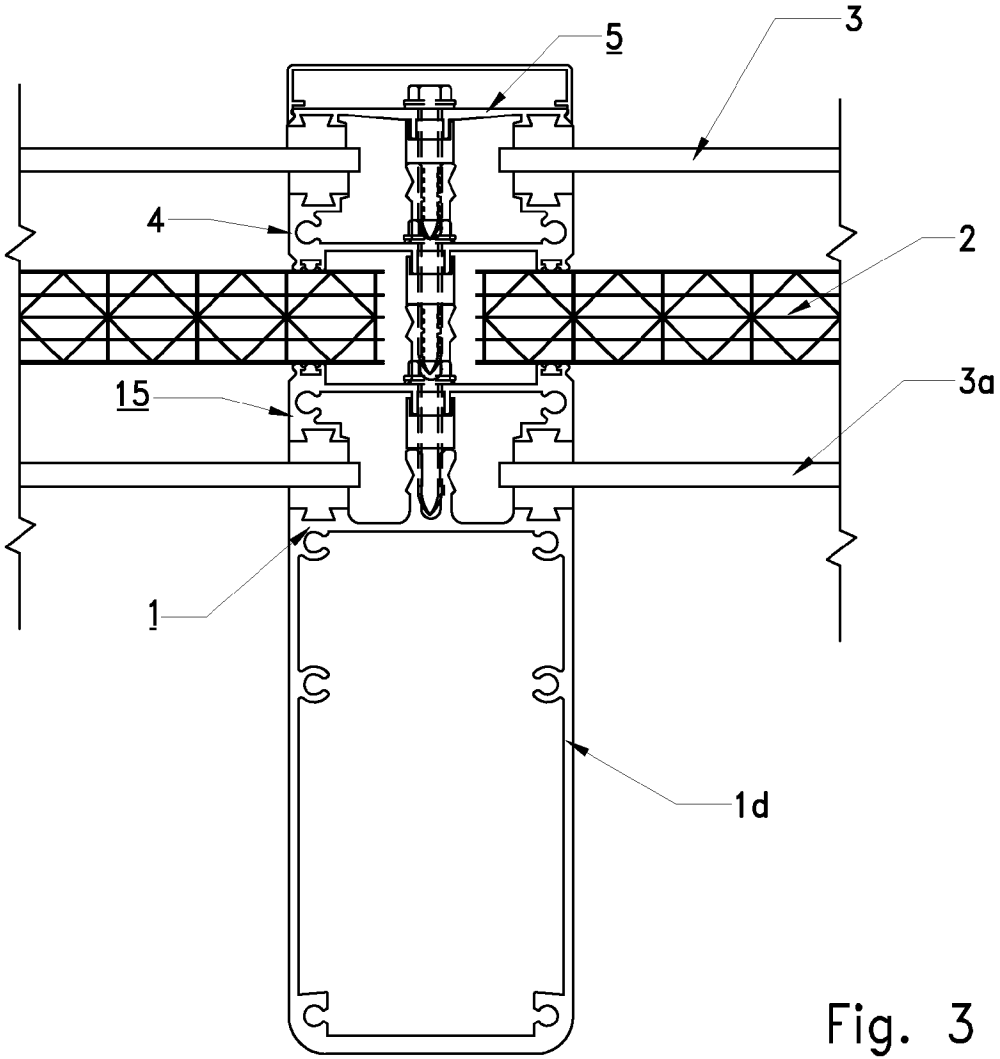
FIG. 3 shows a cross-sectional view through the frame of an assembled alternative embodiment of the panel system wherein a third or additional glass panel can be utilized.
Figure 4:
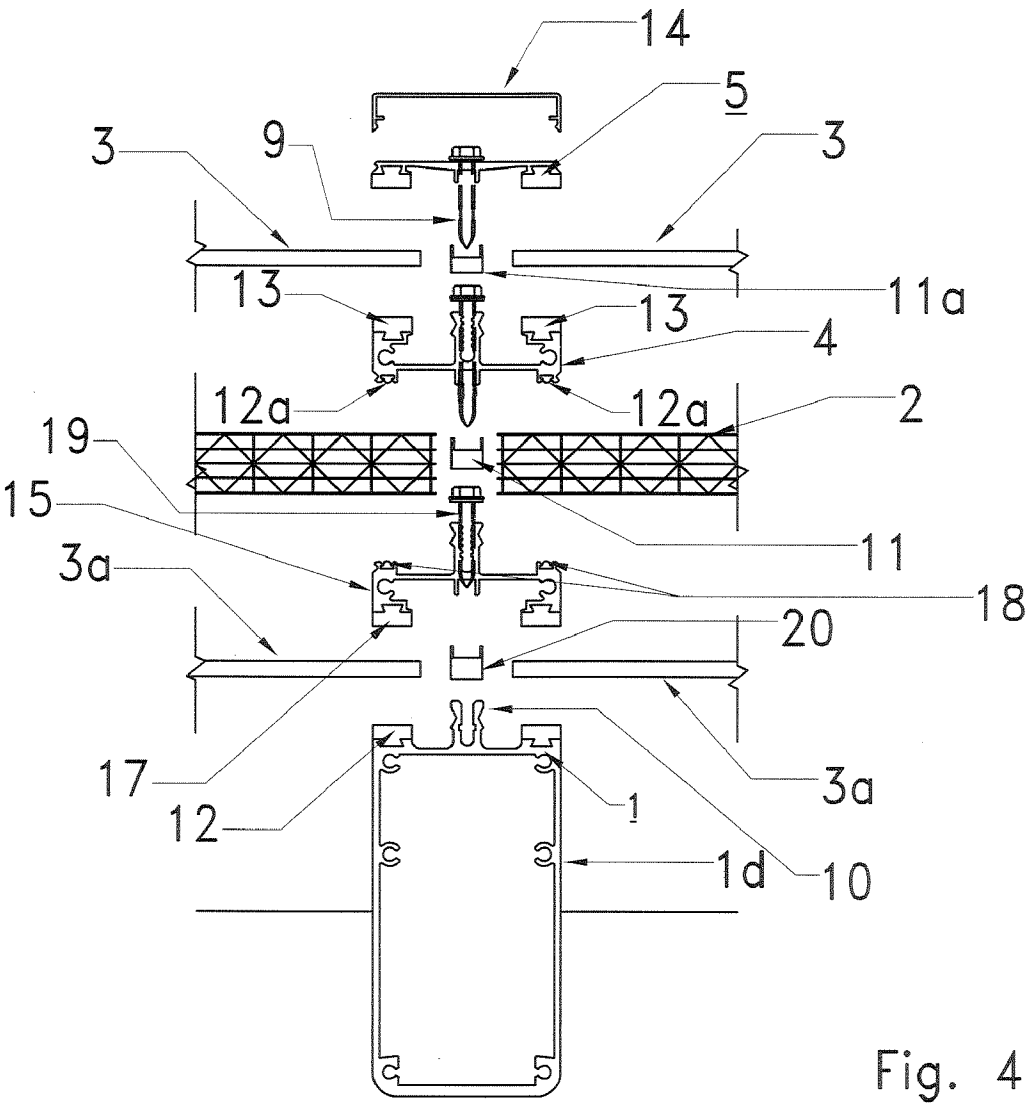
FIG. 4 shows an exploded cross-sectional view of the embodiment shown in FIG. 3.

FIGS. 3-4 in conjunction with 5-7 (extrusion detail) show an alternative embodiment of the instant invention which provides for an additional panel 3*a*. Additional panel 3*a* is preferably glass, similar to top panel 3. This is accomplished by providing a secondary spacer 20 and a secondary extrusion 15, the secondary extrusion 15 having a secondary top 15*a* and a secondary bottom 15*b*. Secondary extrusion 15 is substantially similar to the intermediate extrusion 4, "substantially similar" referring to a difference only in that the gasketing arrangement of the secondary extrusion 15 is flipped and is the reverse of the gasketing arrangement of intermediate extrusion 4 as shown. Secondary extrusion 15 is adapted to be placed between the intermediate extrusion 4 and the base extrusion 1 such that additional panel 3*a* can be captured underneath the secondary extrusion 15 and above the base extrusion 1 using secondary screw 19 to form a three-panel system consisting of the top panel 3, the bottom panel 2, and the additional panel 3*a* (for consistency purposes "bottom panel" still refers to the plastic panel but in the three-panel arrangement the bottom panel is actually the middle panel and the additional panel is the lowermost panel). Note that similar to the first, two-panel embodiment above, each panel in the three-panel embodiment is spaced a distance relative to each other substantially equal to the height of the intermediate extrusion 4 and the height of the secondary extrusion 15. In this three-panel embodiment, as termed herein, secondary top gaskets 18 are disposed at the secondary top 15*a* and secondary bottom gaskets 17 are disposed at the secondary bottom 15*b*. The secondary bottom gaskets 17 are preferably identical to the intermediate top gaskets 13 for disposition against the bottom panel 2, and the secondary top gaskets 18 are preferably identical to the intermediate bottom gaskets 12*a* for disposition against the additional panel 3*a*.

Figure 8:
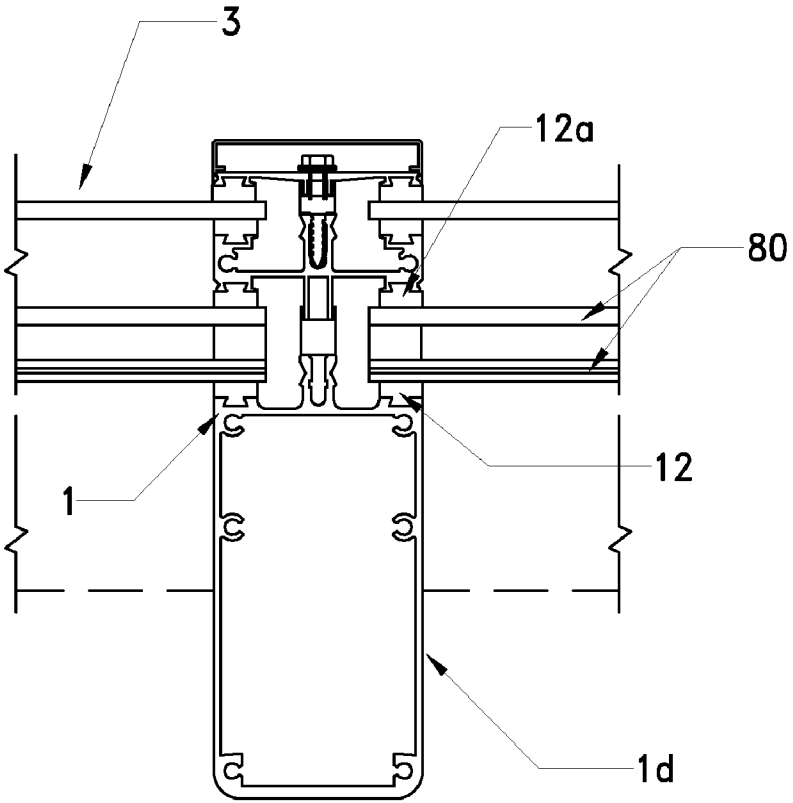
FIG. 8 shows an additional embodiment of the instant invention where the bottom panel of the two-panel embodiment is an insulated glass unit as opposed to plastic.

FIG. 8 shows an alternative embodiment of the panel system, wherein the plastic or polycarbonate bottom panel 2 (FIG. 1) is substituted with an insulated glass unit 80 (IGU). As above, the panel is captured underneath the intermediate extrusion 4 and above the base extrusion 1, situated in contact with the base extrusion gaskets 12 and the intermediate bottom gaskets 12*a*. But here the bottom panel 2 is an insulated glass unit 80 in lieu of cellular polycarbonate, having itself an outer layer of glass (typically ¼") and an inner layer of laminated glass in a single sealed unit. Note all extrusions are the same as in all other embodiments, but the gaskets can all remain the same size since no plastic is being used. For instance intermediate bottom gaskets 12*a* are the same size as base extrusion gaskets 12. The preferred one-inch (1") space between the insulated glass unit 80 and the top panel 3 also still applies, although the IGU itself traditionally has a half-inch (½") airspace.

We claim:

1. A multi-layered, hybrid panel and framing system, comprising:

an upper extrusion for capturing a top panel, said upper extrusion having an upper hole defined therein for receiving an upper screw;

an upper spacer having an upper spacer hole defined therein for receiving said upper screw in alignment with said upper hole of said upper extrusion;

an intermediate extrusion having an intermediate hole defined therein for receiving a lower screw, wherein said intermediate hole is defined offset from said upper hole and said upper spacer hole such that said intermediate extrusion remains in place when said top panel is separately removed for repair and replacement;

a lower spacer having a lower spacer hole defined therein in alignment with said intermediate hole;

a base extrusion formed at the top of a rafter;

a bottom panel captured underneath said intermediate extrusion and above said base extrusion;

said top panel captured above said intermediate extrusion and underneath said upper extrusion, wherein said bottom panel and said top panel are spaced a distance substantially equal to a height of said intermediate extrusion; and, wherein said intermediate further comprises a pair of bosses defined at ends of said intermediate extrusion separating a raised web and lowered web at each said end, each said boss formed as a segmented cylinder adapted to accept a boss screw to secure said intermediate extrusion to a horizontal head member or sill.

2. The panel system of claim 1, further comprising said upper screw fastened through said upper hole and through said upper spacer hole joining said upper extrusion and said upper spacer to said intermediate extrusion so as to provide a compression force to secure said top panel.

3. The panel system of claim 1, further comprising said lower screw fastened through said intermediate hole and through said lower spacer hole joining said intermediate extrusion and said lower spacer to said base extrusion so as to provide a compression force to secure said bottom panel.

4. The panel system of claim 2, wherein said intermediate extrusion further comprises a generally U-shaped, intermediate extrusion track in alignment with said upper hole and said upper spacer hole to capture said upper screw.

5. The panel system of claim 3, wherein said base extrusion further comprises a generally U-shaped, base extrusion track in alignment with said intermediate hole and said lower spacer hole to capture said lower screw.

6. The panel system of claim 2, further comprising a pair of upper channel elements projecting downward from a bottom surface of said upper extrusion defining an upper channel through which said upper screw can be guided, said upper channel elements sized to be accommodated within said upper spacer.

7. The panel system of claim 3, further comprising a pair of intermediate channel elements projecting downward from a bottom surface of said intermediate extrusion defining an intermediate channel through which said lower screw can be guided, said intermediate channel elements sued to be accommodated within said lower spacer.

8. The panel system of claim 1, wherein said bottom panel is plastic.

9. The panel system of claim 8, wherein said bottom panel is cellular polycarbonate.

10. The panel system of claim 1, wherein said bottom panel is an insulated glass unit.

11. The panel system of claim 1, wherein said top panel is glass.

12. The panel system of claim 1, further comprising a cap adapted to clip onto said upper extrusion to hide said upper screw.

13. The panel system of claim 1, further comprising a secondary spacer and a secondary extrusion, said secondary extrusion substantially similar to said intermediate extrusion adapted to be placed between said intermediate extrusion and said base extrusion such that an additional panel can be captured underneath said secondary extrusion and above said base extrusion to form a three-panel system consisting of said top panel, said bottom panel, and said additional panel, each said panel spaced a distance relative to each other substantially equal to the height of said intermediate extrusion and the height of said secondary extrusion.

* * * * *